United States Patent [19]

Noble

[11] Patent Number: 5,024,059

[45] Date of Patent: Jun. 18, 1991

[54] ELECTRONIC FORCE IONIZED GAS AIR CONDITIONING SYSTEM COMPRESSOR

[76] Inventor: Jerry D. Noble, 883A Dublin, Richardson, Tex. 75080

[21] Appl. No.: 540,762

[22] Filed: Jun. 20, 1990

[51] Int. Cl.[5] ..... F25B 21/00

[52] U.S. Cl. ..... 62/3.1

[58] Field of Search ..... 62/3.1, 6

[56] References Cited

U.S. PATENT DOCUMENTS

| | | | |
|---|---|---|---|
| 4,033,734 | 7/1977 | Steyert, Jr. et al. | 62/3.1 |
| 4,107,935 | 8/1978 | Steyert, Jr. | 62/3.1 |
| 4,332,135 | 6/1982 | Barclay et al. | 62/3.1 |
| 4,507,927 | 4/1985 | Barclay | 62/3.1 |
| 4,532,770 | 8/1985 | Hakuraku et al. | 62/3.1 |

*Primary Examiner*—Lloyd L. King

*Attorney, Agent, or Firm*—Warren H. Kintzinger

[57] ABSTRACT

An ionized gas drive system is provided wherein electrically charged gas atoms (or molecules) moving through a magnetic field at right angles to the lines of flux experience a force at right angles to it's direction of motion and to the magnetic field. A motor driven rotor mounting a plurality of permanent magnet elements all mounted with common polarity outward is mounted for rotation within an annular ring of gas passages extending between a low pressure gas manifold and a high pressure gas manifold. Each gas passage includes a conductive wire extension part within and partly to the outside of the respective gas passages that, with rotation of the magnetic mounting rotor and movement of the magnetic field lines of force develops an induced electronic flow whereby gas atoms touching the portion of the wire extension take an electron from the gas atom. The resultant ionization of the gas atoms is an aid to the gas being moved by the moving magnetic field generated with rotation of the rotor. When an electron is removed from an atom's electron cloud the atomic diameter is reduced beneficially causing the atom to emit energy in the form of heat. All of these functions are accomplished in a hermetically sealed gas system that is not invaded by any mechanically moving device.

20 Claims, 2 Drawing Sheets

ELECTRONIC FORCE IONIZED GAS AIR CONDITIONING SYSTEM COMPRESSOR

Figure 1:
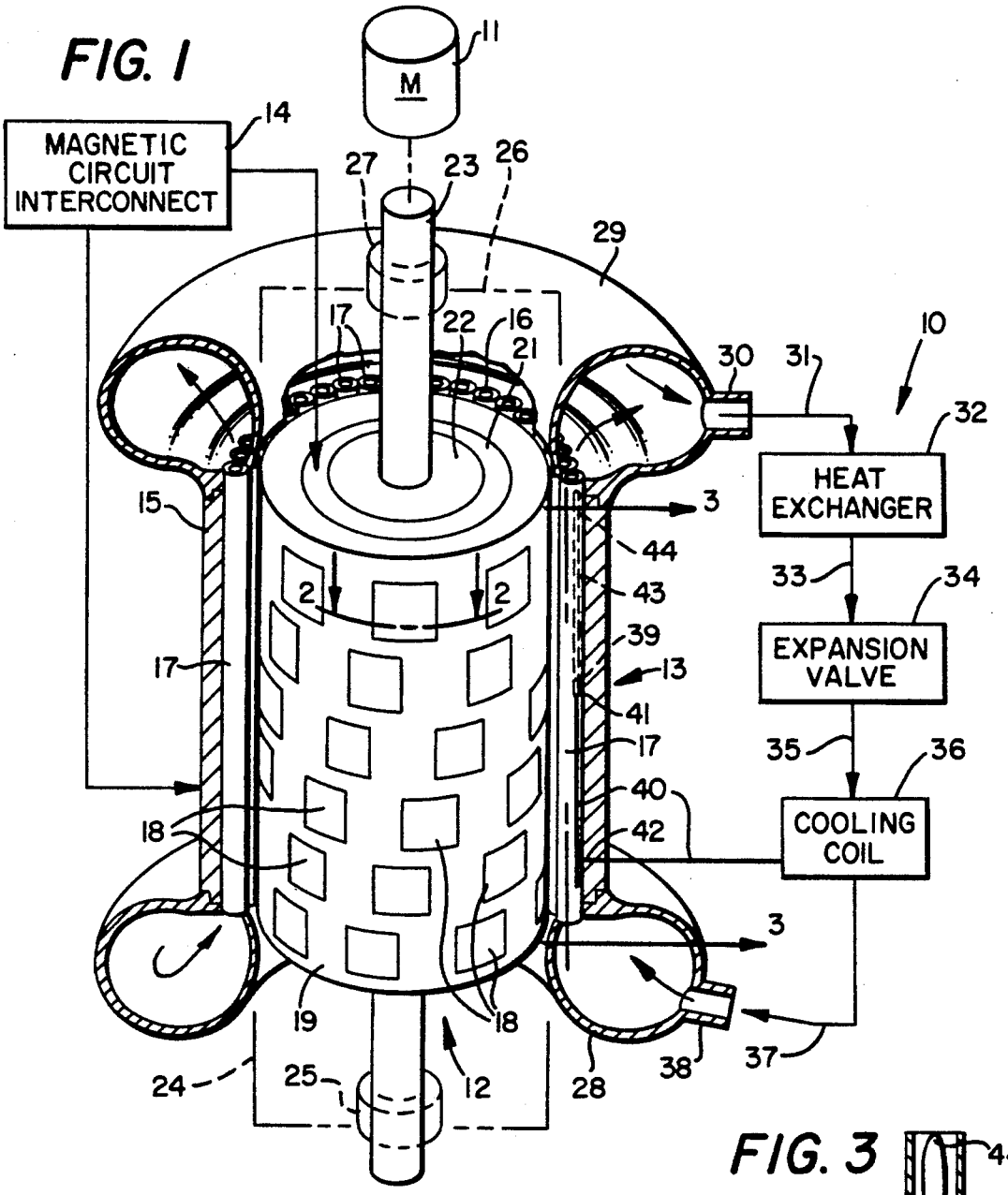

This invention relates in general to air conditioning system compressors, and more particularly, to an electronic force ionized gas air conditioning system compressor.

Most, if not all, present air conditioning systems have compressor pumping units where moving parts extend from the exterior to the interior of the refrigerant material (gas or gas and liquid in change of state systems) enclosing loop. This leads to gas leakage through seals where a shaft or other member extends from the exterior to the interior of the gas refrigerant loop enclosure. Further, the fact that leakage can develop limits selection of refrigerant materials that can be used. Freon, for example, that leaks to the atmosphere is harmful to the ozone layer high in the stratosphere and ammonia gas when it leaks has a strong smell and is injurious when exposed, in material quantities, to the human body system. If, however, the gas enclosure and container loop of an air conditioning system were completely enclosed without moving elements extended through gas enclosure walls gases that would be hazardous if they were to leak could be used, gases that could be easier to ionize such as freon or ammonia. Other gases that are useable include inert gases such as Nitrogen, Argon, Helium, Hydrogen, dry air and a forming gas mixture (i.e. Nirtogen and Hydrogen). Freon is a member of a family of chlorofluorcarbons (CFC's) banned in the U.S. in 1978 from use in spray cans after the discovery that these gases release ozone-destroying chlorine particularly when they have risen to the ozone layer in the stratosphere under intense radiation from the sun.

It is, therefore, a principal object of this invention to provide closed gas chamber air conditioning systems where gas leakage is eliminated.

Another object with such air conditioning systems is to minimize ozone layer destruction from chlorine released from gases in the stratosphere.

A further object is to provide such air conditioning systems where there are no moving structural components within the closed gas chamber of the system.

Still another object is to provide such air conditioning systems that are substantially vibration free with improved operating efficiencies and to lower operational power demands.

Features of the invention useful in accomplishing the above objects include, in an electronic ionized gas air conditioning system compressor, in an ionized gas drive system wherein electrically charged gas atoms (or molecules) moving through a magnetic field at right angles to the lines of flux experience a force at right angles to it's direction of motion and to the magnetic field. A motor driven rotor mounting a plurality of permanent magnet elements all mounted with common polarity outward is mounted for rotation within an annular ring of gas passages extending between a low pressure gas manifold and a high pressure gas manifold. Each gas passage includes a conductive wire extension part within and partly to the outside of the respective gas passages that, with rotation of the magnet mounting motor and movement of the magnetic field lines of force develops an induced electronic flow whereby gas atoms touching the portion of the wire extension take an electron from the gas atom. The resultant ionization of the gas atoms is an aid to the gas being moved by the moving magnetic field generated with rotation of the rotor. When an electron is removed from an atom's electron cloud the atomic diameter is reduced beneficially causing the atom to emit energy in the form of heat. All these functions are accomplished in a hermetically sealed gas system that is not invaded by any mechanically moving component.

Specific embodiments representing what are presently regarded as the best modes of carrying out the invention are illustrated in the accompanying drawings.

Figure 3:
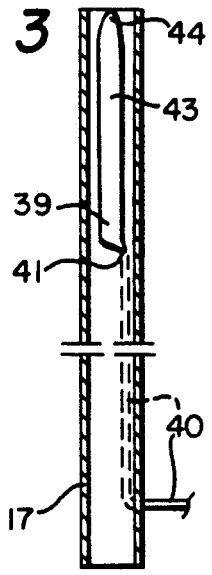
Figure 2:
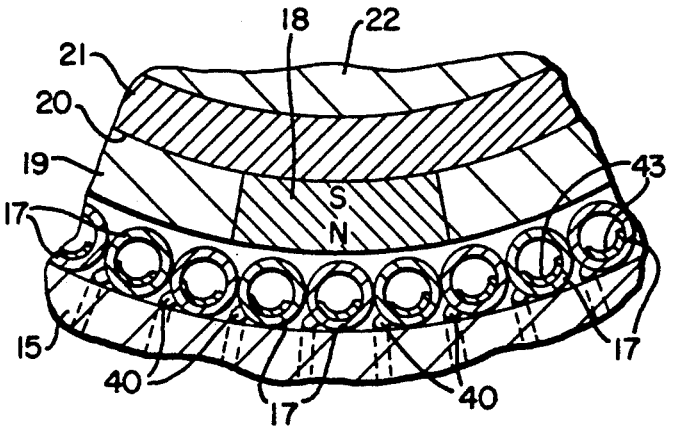
Figure 4:
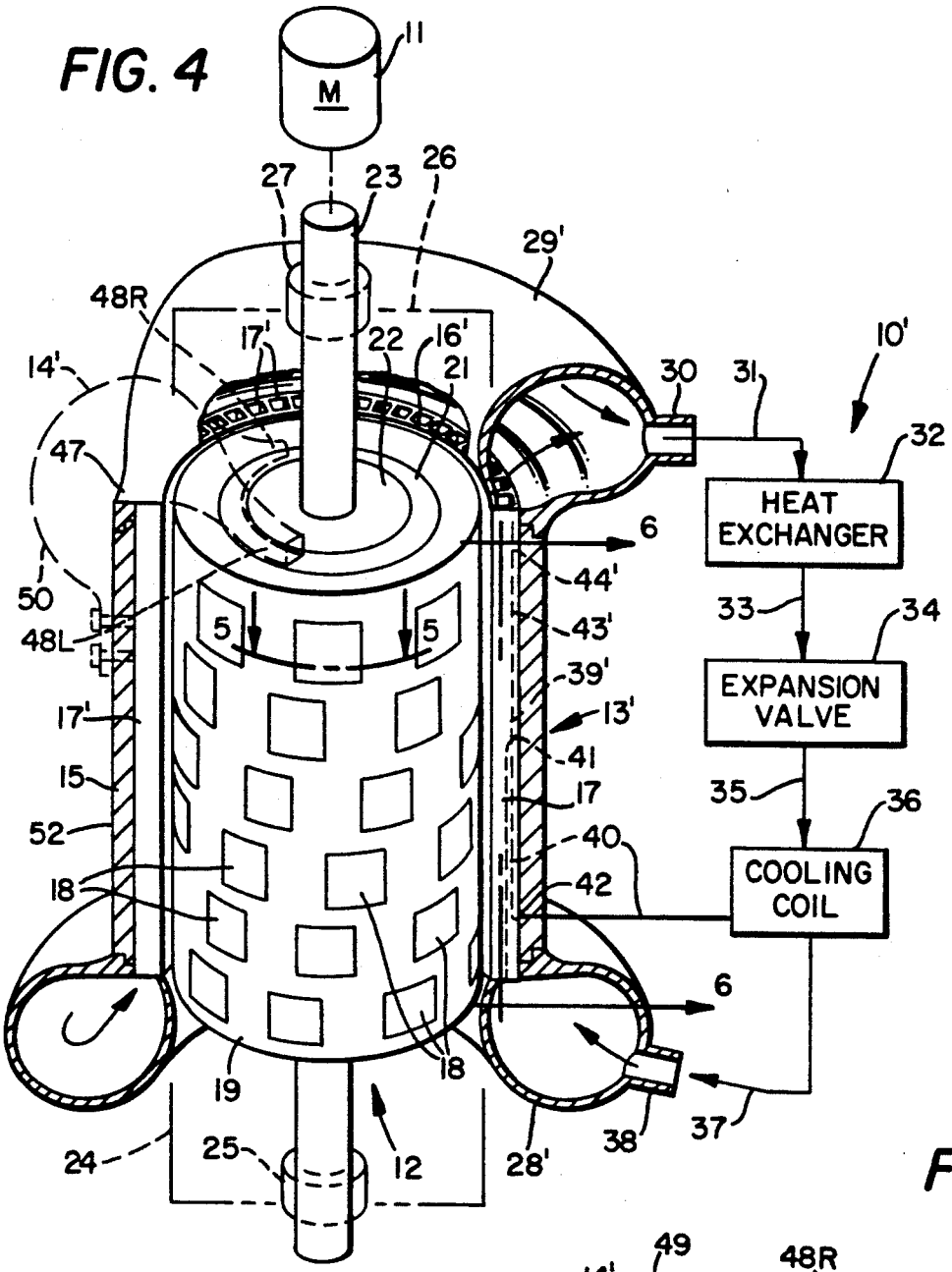
Figure 5:
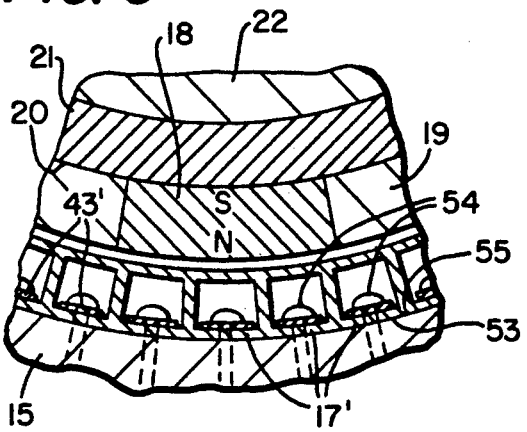
Figure 7:
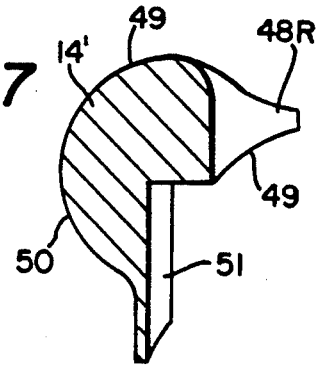
Figure 6:
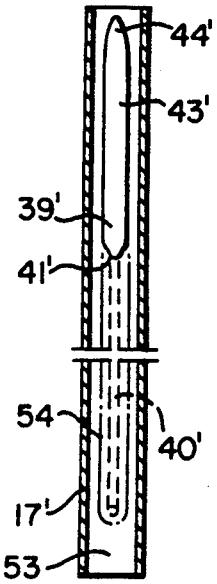

In the drawings:

FIG. 1 represents a combination perspective view of a multi-permanent magnet mounting motor driven rotor gas compressor with a magnetic circuit interconnect in block schematic form and the balance of an air conditioning system in block schematic form;

FIG. 2, a partial cut away and sectioned detail taken along line 2—2 of FIG. 1 showing rotor, magnetic element and gas compressor passage detail;

FIG. 3, a partial cut away view taken along line 3—3 of FIG. 1 showing interior detail of a gas passage with a conductive wire extension partially within and partly to the outside of the gas passage shown;

FIG. 4, a view much like that of FIG. 1 with a magnetic circuit element indicated in phantom and with the annular ring of gas passages rectangular in cross section instead of being round tubes;

FIG. 5, a partial cut away and sectioned detail view taken along line 5—5 of FIG. 4 much like FIG. 2 with, however, the gas passages substantially rectangular in cross section rather than being tubes;

FIG. 6, a patial cut away view taken along line 6—6 of FIG. 4 showing interior detail of a rectangular, in cross section, gas passage with a conductive wire extension partially within and partly to the outside of the gas passage shown; and FIG. 7, a cut away and sectioned detail showing of the magnetic circuit element shown in phantom in FIG. 4.

Referring to the drawings:

The air conditioner system 10 of FIG. 1 includes a motor 11 driven rotor 12 gas compressor 13 with a magnetic circuit interconnect element 14 indicated in block and line schematic form. The gas compressor 13 has an outer magnetic material cylinder 15 (typically iron) enclosing an annular ring 16 of relatively small diameter non-magnetic material tubes 17 that are made of plastic or some other non-magnetic material that has little, if any, effect on magnetic field projections from permanent magnets 18. Referring also to FIG. 2 permanent magnets 18 are mounted in a non-magnetic material (such as plastic or ceramic). rotor cylinder 19 with the plurality of magnets all mounted with common polarity outward and in rotationally staggered relation and in mutually spaced relation one from the other. With north poles of the magnets 18 outward the inner south poles rest against the outer surface 20 of a magnetic circuit material (iron) rotor tube 21 with a non-magnetic material cylindrical plug 22 within the magnetic material tube 21. A rotor 12 mounting shaft 23 extends through from above plug 22 to below plug 22 with a bottom mounting frame 24 held bearing 25 rotatably supporting the rotor mounting shaft 23 at the bottom and a top mounting frame 26 held bearing 27 rotatably supporting the shaft 23 at the top. Drive motor 11 is drive connected to the top of rotor shaft 23 (motor 11 could be replaced by a belt and pulley drive such as would be applicable in a vehicle installation).

A bottom annular gas manifold 28 made of non-magnetic plastic or ceramic material is mounted on the bottom of cylinder 15 and is open to the bottom of tubes 17. Top gas outlet annular manifold 29, also made of non-magnetic plastic or ceramic material, is mounted on the top of cylinder 15 and is open to the top of tubes 17. The outlet 30 of top annular manifold 29 is line 31 connected to heat exchanger 32 in turn line 33 connected to expansion valve 34 in turn line 35 connected to cooling coil 36 that has an output line 37 connection to the gas inlet 38 of bottom annular manifold 28.

Referring additionally to FIG. 3 interior detail facing outward from line 3—3 of FIG. 1 of a gas passage tube 17 is shown. A conductive member 39 is shown having a bottom wire extension 40 extending from the interior of tube 17 through wall opening 41 and down the outside of tube 17 within cylinder 15 to passage through opening 42 in cylinder 15 and on to connection with cooling coil 36 with wire extension 40 insulated from its exit to the outside of tube 17 to connection with the coling coil 36. An upper extension 43 of conductive member 39 is flattened against the inside of the outer side of the tube 17 shown and extends upward in this form from wall opening 41 to an upper tapered point end 44 adjacent the upper end of the tube 17. Each of the tubes 17 is equipped with a conductive member 39 wherein the bottom wire extensions 40 are offset to one side of it's tube 17 for clearance purposes and to permit the tubes 17 to be bonded to the inner surface 45 of the outer magnetic material cylinder 15. Clearance between the outer surface 46 of the rotor cylinder 19 and the innermost extent of tubes 17 provides for relative rotation of the rotor cylinder 19 with its permanent magnets 18 within the annular ring of tubes 17.

The magnetic circuit of the gas compressor 13 extends outward from the north poles of permanent magnets 18 through the gap including the annular ring 16 of tubes 17 to the magnetic material cylinder 15 on through magnetic circuit interconnect element 14 to magnetic material tube 21 and the south poles of the magnets 18. With a three thousand Gauss magnetic field density projection from the north poles of magnets 18 and an adequate turn rate of rotor 12 to attain a rotor surface speed of 132 feet per second as driven by motor 11 a desired gas flow rate is developed. This gas compressor system in addtion to the air conditioned compressor application is also applicable in other situations where it is useful to circulate certain gases in closed loop vessels. It is particularly suited for use in the pumping of caustic and corrosive gases that "eat" conventional pumps and compressors.

Electro-magnetic induction is used to compress ionized gases in air conditioning systems and for other purposes. Basically an electrically charged particle moving through a magnetic field (or if the magnetic field is being moved relative to the particle) at right angles to the lines of flux experiences a force at right angles to the direction of motion and to the magnetic field. The magnitude of this force is calculated by multiplying the flux density B times the charge E times the relative velocity of the particle V with the formula being BEV with this being essentially the same way electric current is generated in a conductor. Use of this principle in gas compression for air conditioning an ionized gas atom (or molecule) having a net electrical charge is subject to the same electromotive force and, being free to move, will flow in the tubes 17. With gas flow restricted this electromotive force effectively compresses the gas with very little friction losses during the compression process.

Ionizing a gas by removing electrons from gas atoms (or molecules) thereby creating positive ions is very helpful in the gas pumping process optimizing electromotive force (EMF) effect on the gas being circulated or compressed. When an electron is removed from an atom's electron cloud the atomic radius is dramatically decreased causing the atom (or molecule) to emit heat energy. Recombining electrons with atoms (or molecules) in the expansion chamber of an air conditioning system (i.e. the cooling coil) the gas absorbs heat.

With respect to gas particle ionization, referring to FIG. 1, arrows in the small diameter compression tubes 17 indicate the direction of motion of positive gas ions when the rotor 12 is turning. Since opposite charges within the same moving magnetic field are subject to forces in opposite directions the negatively charged electrons are forced to move in the opposite direction to the arrows. An electrical conductive material wire (such as copper) has a flattened portion ending in a point at the top inner top side of each tube 17 and extended down to a mid point of the tube where it exits the tube wall and then extends down outside the tube to adjacency with the bottom of the tube where it exits through the wall of cylinder 15 for connection mutually together with cooling coil 36. This wire 39 has an induced voltage causing the wire portion 43 inside each tube to have a positive charge. Gas atoms (or molecules) inside tubes 17 having no net charge are attracted to the charged wire portions 43 and upon contact with the wire portion 43 they give up electrons leaving both the wire and the gas atoms (or molecules) with a net positive charge. Since like charges repel each other the ionized atoms (or molecules) move away from the wire portion 43 and are forced in the direction of the arrows by the moving magnetic field emanating from the permanent magnets mounted on the rotating rotor 12. Electrons leaving the tubes 17 via the copper wire can (and many will) recombine with gas atoms (or molecules) in the system cooling coil.

Since the gas flow system enclosure is a completely sealed gas containing loop objections to some refrigeant gases is covercome since they would escape to the atmosphere only when a system is ruptured as in an accident or possibly when a system is discarded. While all atoms (or molecules) of a gas may not become ionized enough to move and compress the gas those not ionized will be carried along by those that are ionized. This is particularly the case where a forming gas mixture is used with one of the gases of the mixture being a high ionization gas such as ammonia or freon. Further, it is significant that with sealed gas loop systems and no mechanical moving components invading the sealed gas loop system no lubricant fluid is needed within the sealed gas loop that would travel with the gas. This makes the system more efficient since the charge to the system would be one hundred percent refrigerant gas.

Referring now to the embodiment of FIGS. 4–7 wherein rectangular in cross section, gas passages 17' are used in place of gas tubes 17 and a magnetic circuit element 14' is used and the upper manifold 29' is shaped down to a minimum level 47 where element 14' passes thereover in order to keep the magnetic circuit element 14' as short as possible. Component parts and features the same as in the embodiment of FIGS. 1, 2 and 3 are numbered the same without repeating some of the description again, and portions changed, yet related, are given primed numbers with description here directed primarily to those areas of change as a matter of convenience. THe magnetic circuit element 14', indicated in phantom in FIG. 4 and in detail in FIG. 7, is shown to have opposite side arcuate projections 48L and 48R such as to have an arcuate planar area 49 closely adjacent to yet spaced from the top of rotor magnetic material tube 21 for an adequate area in cross section for transmission of the magnetic lines of force thereto even when the rotor 12 is driven in rotation. The magnetic circuit 14' from the opposite side arcuate projections 48L and 48R is shaped to a thickened intermediate interconnect portion 49 extending across the minimum level portion 47, of the upper manifold 29', to a downward depending portion 50. Element 14' portion 50 has an inner arcuate surface 51 conformed to and bearing against the outer surface 52 of the fixed position outer magnetic material cylinder 15 to which it is fastened as by screws (or by a bonding agent). The element 14' is shaped throughtout it's extent to insure adequate cross sectional area for transmission of the magnetic field lines of force therethrough from the top of tube 21 to the outer magnetic circuit material cylinder 15.

The interior detail facing outward from line 6—6 of FIG. 4 of a gas passage member 17' includes a conductive member 39' having a bottom wire extension 40' extending from the interior of member 17' through wall opening 41' and then down the outside of the outer wall 53 of passage member 17'. Passage member 17' outer wall 53 is arched 54 to accomodate the thickness through a length of insulated wire 40' between the outer wall 53 and the inner wall 55 of cylinder 15 down to passage of the insulated wire 40' through opening 42 in cylinder 15 and on to connection with cooling coil 36. THe upper extension 43' of conductive member 39' is flattened against the inside of the outer wall 53 of the gas passage 17' extending upward from wall opening 41' to upper tapered point end 44' adjacent the upper end of gas passage 17'. It should be noted that the poles of the permanent magnets mounted in rotor 12 could be reversed and the same desired operational results obtained by driving the rotor 12 in the opposite direction of rotation than the correct rotational direction of drive for the embodiments shown and described.

Whereas this invention has been described with respect to several embodiments thereof, it should be realized that various changes may be made without departure from the essential contributions to the art made by the teachings hereof.

I claim:

1. An ionized gas drive system comprising: gas passage means; multiple magnet elements mounted in a rotational carrier with the multiple magnet elements mounted in mutually spaced relation and in common polarity; drive means connected to drive said rotational carrier in rotation; a magnetic circuit with a gap through which said gas passage means extends substantially at right angles to the rotational direction of said rotational carrier and movement of the magnetic field lines of force emanating from common poles of the multiple magnet elemets and extended through the gap of the magnetic circuit.

2. The ionized gas drive system of claim 1, wherein said rotational carrier is a rotationally mounted cylindrical rotor; said magnetic circuit includes, a magnetic circuit material tube, said multiple magnet elements mounted in a non conductive material sleeve on said tube with the multiple magnet elements having their inner poles against the outer surface of said tube, an outer cylinder of magnetic circuit material enclosing said gap from said multiple magnet elements, and a magnetic circuit bridge element mounted on said outer cylinder having a radially inward extension to close proximity with an end of said tube.

3. The ionized gas drive system of claim 2, wherein said gas passage means is an annular ring of relatively small cross sectional area passages made of non-magnetic material mounted on the inside wall of said outer cylinder positioned in the gap between the outer surface of said cylindrical rotor and said outer cylinder with clearance from the rotor for relative rotation of the rotor; and a hermetically sealed gas closed loop flow system including said gas passage means.

4. The ionized gas drive system of claim 3, wherein said annular ring of relatively small cross sectional area passages is an annular ring of relatively small diameter non-magnetic material tubes.

5. The ionized gas drive system of claim 4, wherein an input annular gas manifold of non-magnetic material is mounted on a first end of said outer cylinder in open gas flow communication with an input end of said annular ring of tubes.

6. The ionized gas drive system of claim 5, wherein an output annular gas manifold of non-magnetic material is mounted on a second end of said outer cylinder in open gas flow communication with an output end of said annular ring of tubes.

7. The ionized gas drive system of claim 6, wherein said output annular gas manifold is part of a closed gas flow loop in an air conditioning system including, from an outlet of said output annular gas manifold connection to a heat exchanger, and serially, on through an expansion valve, a cooling coil and back through an inlet to said input annular gas manifold.

8. The ionized gas drive system of claim 7, with a gas ionizing conductive material extension extended along individual passages of said gas passage means partially within as a gas ionization portion, and partially outside respective passages; and connection of said extension to means feeding electrons to the gas in a portion of the gas closed loop flow system.

9. The gas drive system of claim 8, wherein said portion of the gas closed loop system is said cooling coil.

10. The ionized gas drive system of claim 1, with a hermetically sealed gas closed loop flow system including said gas passage means; and a gas ionizing conductive material extension extended along individual passages of said gas passage means partially within as a gas ionization portion, and partially outside respective passages; and connection of said extension to means feeding electrons to the gas in a portion of the gas closed loop flow system.

11. The ionized gas drive system of claim 3, with a gas ionizing conductive material extension extended along individual passages of said gas passage means partially within as a gas ionization portion, and partially outside respective passages, and connectiion of said extension to means feeding electrons to the gas in a portion of the gas closed loop flow system.

12. The ionized gas drive system of claim 11, wherein said annular ring of relatively small cross sectional area passages is an annular ring of substantially rectangular in cross section passages of non-magnetic material.

13. The ionized gas drive system of claim 12, wherein an input annular gas manifold of non-magnetic material is mounted on a first end of said outer cylinder in open gas flow communication with an input end of said annular ring of passages.

14. The ionized gas drive system of claim 13, wherein an output annular gas manifold of non-magnetic material is mounted on a second end of said outer cylinder in open gas flow communication with an output end of said annular ring of passages.

15. The ionized gas drive system of claim 14, wherein said output annular gas manifold is part of a closed gas flow loop in an air conditioning system including, from an outlet of said output annular gas manifold connection to a heat exchanger, and serially, on through an expansion valve, a cooling coil and back through an inlet to said input annular gas manifold.

16. The ionized gas drive system of claim 10, wherein said gas includes a relatively easy to ionize gas in the class of ammonia and chlorofluorcarbon gases; and where the gas used is one hundred percent of the charge in the hermetically sealed gas closed loop flow system.

17. The ionized gas drive system of claim 16, wherein said gas is a forming gas including a gas from the class Nitrogen, Argon, Helium, Hydrogen and Dry Air.

18. An ionized gas drive system where electrically charged gas particles (atoms or molecules) are moved through a magnetic field at right angles to lines of flux experience a force at right angles to the magnetic fields direction of motion comprising: a motor driven rotor mounting a plurality of permanent magnet elements all mounted with common polarity outward; mounting means mounting said rotor for rotation within an annular ring of gas passages extended between a low pressure gas manifold and a high pressure gas manifold; an electrical conductive material extension partly within and partly to the outside of individual gas passages positioned so that, with rotation of the magnet mounting rotor and resultant movement of the magnetic field flux lines of force, an induced electron flow develops whereby gas particles touching the portion of the wire extension lose an electron to the wire extension with the resultant ionization of the gas particles being an aid to the gas being moved by the moving magnetic field emanating from the magnets on the rotor with rotation of the rotor, with as an electron being removed from a gas particle electron cloud the particle size being reduced causing the particle to emit energy in the form of heat; and connection of said electrical conductive material extension to a portion of a hermetically sealed gas system, of said ionized gas drive system, that is not invaded by any mechanically moving device.

19. The ionized gas drive system of claim 18, wherein said gas includes a relatively easy to ionize gas in the class of ammonia and chlorofluorcarbon gases; and where the gas used is one hundred percent of the charge in the hermetically sealed gas loop flow system.

20. The ionized gas drive system of claim 19, wherein said gas is a forming gas including a gas from the class Nitrogen, Argon, Helium, Hydrogen and Dry Air.

* * * * *